United States Patent [19]

Frentzel-Beyme

[11] 4,281,508

[45] Aug. 4, 1981

[54] YARN BRAKE MECHANISM

[75] Inventor: Johannes Frentzel-Beyme, Monchen-Gladbach, Fed. Rep. of Germany

[73] Assignee: Palitex Project Company GmbH, Krefeld, Fed. Rep. of Germany

[21] Appl. No.: 136,419

[22] Filed: Apr. 2, 1980

[30] Foreign Application Priority Data

Apr. 11, 1979 [DE] Fed. Rep. of Germany ..... 2914656

[51] Int. Cl.[3] ..... D01H 13/10; D01H 7/86; B65H 59/22; D01H 15/00

[52] U.S. Cl. ..... 57/279; 57/58.86; 242/149

[58] Field of Search ..... 57/58.49, 58.83, 58.86, 57/58.7, 279, 280, 352, 357; 242/147 R, 149, 152.1

[56] References Cited

U.S. PATENT DOCUMENTS

| | | | |
|---|---|---|---|
| 3,352,510 | 11/1967 | Franzen | 242/149 |
| 3,410,071 | 11/1968 | Heimes | 57/58.49 |
| 3,945,184 | 3/1976 | Franzen | 57/279 X |
| 3,975,893 | 8/1976 | Franzen | 57/279 |
| 4,030,683 | 6/1977 | Eckholt | 57/58.86 X |

FOREIGN PATENT DOCUMENTS

| | | | |
|---|---|---|---|
| 2309578 | 9/1974 | Fed. Rep. of Germany | 57/58.86 |

*Primary Examiner*—John Petrakes

*Attorney, Agent, or Firm*—Bell, Seltzer, Park and Gibson

[57] ABSTRACT

A yarn brake which may be utilized on a textile yarn processing machine, such as a two-for-one twister, for applying tension to a moving yarn and wherein a movable braking body is held in applied position against a braking surface and is separated therefrom during threading of the yarn through the yarn brake. An intercepting means is provided for receiving and holding the braking body, upon separation thereof from the braking surface during threading, in a position in which the braking body and braking surface remain substantially aligned for easily returning to braking engagement after the yarn threading.

10 Claims, 6 Drawing Figures

YARN BRAKE MECHANISM

FIELD OF THE INVENTION

This invention relates to a yarn brake which may be utilized on a textile yarn processing machine, such as a two-for-one twister, for applying tension to a moving yarn and wherein a movable braking body is held in applied position against a braking surface and is separated therefrom during threading of yarn through the yarn brake.

BACKGROUND OF THE INVENTION

Heretofore, yarn brakes of this type have been proposed, as for example in German Patent Specifications OS No. 2 309 578, AS Nos. 25 43 018 and 1 510 807, which utilize a brake housing defining a yarn passageway therethrough and having a braking body movably positioned within the passageway for contact with upper and lower braking rings surrounding the passageway to apply tension to a yarn moving through the brake mechanism. One of the braking rings may be axially movable in this type of brake mechanism under the influence of a mechanical or pneumatic force or other mechanisms may be provided for separation of the braking body from the braking rings to open the passageway through the brake mechanism for manual or pneumatic threading of the yarn through the brake mechanism.

All of the yarn brakes of the above-discussed general type known to applicant, and including the yarn brakes of the aforementioned German Patent Specifications, are susceptible to problems with respect to re-establishing good or proper braking engagement between the braking body and the braking rings. In all of these types of yarn brakes, the braking body is laterally moved to some extent out of alignment with the braking surfaces of the braking rings during the threading operation of the yarn brake and may become tilted or inclined during return of the braking body into its axially-aligned position with the braking surfaces of the braking rings. This is particularly acute in the case of the use of a magnetic means for holding the braking body out of braking position with the braking rings during threading up of the yarn brake, such as is disclosed in German Patent Specification OS No. 2 309 578, due to the possibility of the braking body being unevenly detatched from the magnetic means retaining it when it is desired to return the braking body to an axially-aligned position in braking engagement with the braking rings. Additionally, the provision of such a magnetic means involves additional constructional expenses.

SUMMARY OF THE INVENTION

With the foregoing in mind, it is an object of the present invention to provide an improved construction of a yarn brake of the type wherein a braking body is held in applied position against a braking surface and is separated therefrom during threading of yarn through the yarn brake and in which the problem presented with prior yarn brakes with respect to restoring proper axial alignment of the braking body with the braking surfaces is overcome.

This object is achieved in accordance with the present invention by an improved yarn brake of this type in which the braking body is maintained in axial alignment with the braking surfaces during the threading operation, without interfering with that operation, so that the braking body may readily return into proper braking engagement with the braking surfaces upon completion of the threading operation.

For this purpose, intercepting means are mounted in the passageway of the brake housing and are constructed and positioned for receiving and holding the braking body, upon separation of the braking body from the braking surface during yarn threading, in a position in which the braking body and braking surface remain substantially aligned for easily returning to braking engagement after the yarn threading.

This type of improved yarn brake construction is particularly adaptable for use in a spindle assembly of a textile yarn processing machine, especially a two-for-one twister, having a hollow spindle defining an axial yarn passageway extending therethrough and including pneumatic threading mechanisms for selectively creating a pneumatic flow in the yarn passageway to automatically thread a yarn therethrough during threading-up operations.

Accordingly, it is a further object of this invention to provide such a spindle assembly which includes an improved yarn brake of the character above described.

BRIEF DESCRIPTION OF THE DRAWINGS

Some of the objects and advantages of this invention having been stated, other objects and advantages will become apparent as the description proceeds when taken in conjunction with the accompanying drawings, in which.

DESCRIPTION OF THE ILLUSTRATED EMBODIMENT

Figure 1:
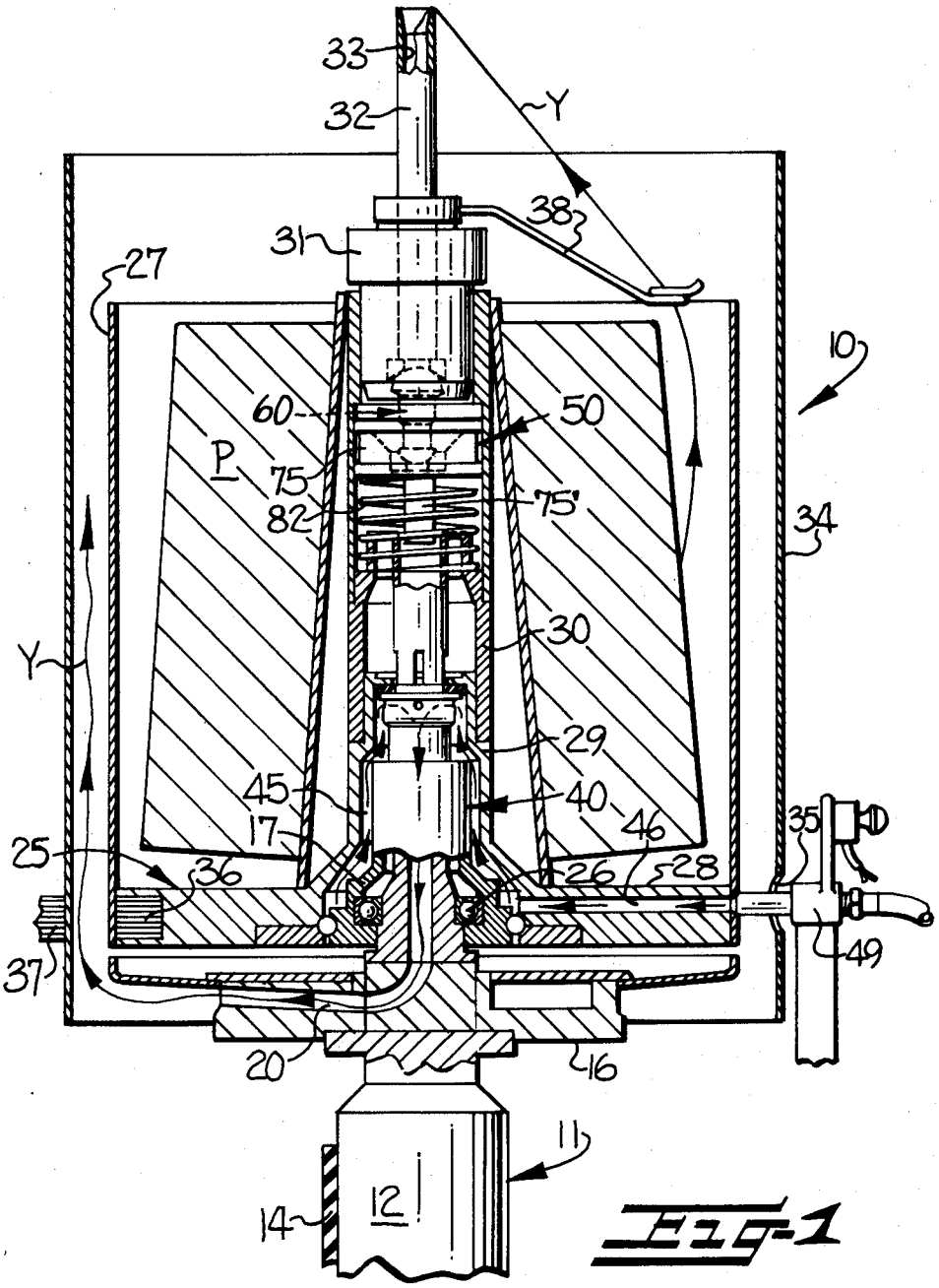
FIG. 1 is a cross-sectional elevational view of one spindle assembly of a two-for-one twister textile yarn processing machine utilizing the improved yarn brake mechanism of this invention.

Referring now more particularly to the drawings, the yarn brake of this invention is generally indicated by the reference numeral 50. For purposes of illustration the yarn brake 50 is shown as part of a spindle assembly of a two-for-one twister textile yarn processing machine. While this may be a preferred environment for the use of the yarn brake 50, such yarn brake 50 may also be utilized in other textile yarn processing machines and textile machines of a different nature. For example, such yarn brake 50 may be utilized in textile machines where a yarn runs off a creel and is fed to a processing unit, such as magazine creels or warp creels. Spoolers and doubling winders also utilize yarn brakes for allowing the yarn to pass under uniform tension onto a package in a creel. Yarn brakes are further required in spool or bobbin magazines, such as on power looms wherein the filling yarns have to be appropriately tensioned prior to inserting yarn picks.

Referring now to FIG. 1, there is illustrated therein a schematic cross-sectional view of a single spindle assembly station, generally indicated at 10, of a two-for-one twister textile yarn processing machine. It is to be understood that a plurality of these spindle assembly stations 10 are provided in side-by-side relationship in two full rows along the outside of the machine. A full illustration and description of the entire two-for-one twister textile yarn processing machine is not given herein and is not believed to be necessary for an understanding of the present invention, the operation and complete structure of such a two-for-one twister being well understood by those with ordinary skill in the art.

Generally, each spindle assembly station 10 comprises a rotatably driven rotor mechanism, generally indicated at 11, which includes a whorl 12 suitably rotatably mounted on a portion of the twister frame (not shown) and rotated by a continuous tengential drive belt 14 in a manner well understood by those with ordinary skill in the art. The rotor mechanism 11 further includes a horizontally-extending yarn reserve disc 16 secured to the whorl 12 for rotation therewith and a generally vertically-extending hollow axle 17 which also rotates with the reserve disc 16. The reserve disc 16 and hollow axle 17 define therewithin a generally L-shaped yarn passageway 20 extending generally vertically through the hollow axle 17 and a portion of the yarn reserve disc 16 and generally horizontally and radially out of the yarn reserve disc 16.

The spindle assembly 10 further includes a stationary carrier mechanism, generally indicated at 25, for supporting and carrying a hollow supply package P of yarn Y. The carrier mechanism 25 is mounted on the rotor mechanism 11 by bearings 26 so that the rotor mechanism 11 may rotate relative to the stationary carrier mechanism 25. The carrier mechanism 25 includes a basket device 27 which surrounds the package P, a circular bottom portion 28 for supporting the hollow yarn supply package P and a hollow tubular hub portion 29 extending upwardly into the hollow yarn supply package P for stabilizing the yarn supply package P. A tubular housing 30 is carried by and extends upwardly from the upper end of the hub portion 29 and in which is contained the pneumatic yarn threading mechanisms and the yarn brake 50, both to be described more fully hereinafter. A cap 31 is mounted at the upper end of the tubular housing 30 or at the upper end of a brake housing 51 to be described more fully below, from which extends a hollow tubular yarn entry tube 32.

The yarn entry tube 32 has an axially extending passageway 33 for receiving and allowing passage of the yarn Y therethrough. As explained more fully hereinafter, the yarn brake and the associated yarn threading mechanism also have axially extending yarn passageways 52, 24 therethrough aligning with and joining the upper end of L-shaped passageway 20 of the rotor mechanism 11 to thus collectively provide a continuous yarn passageway 33, 52, 24, 20 extending through the spindle assembly 10.

The spindle assembly 10 further includes a balloon limitor 34 surrounding the basket 27 so as to contain a balloon of yarn Y formed around the outside of the basket 27. The balloon limitor 34 has an aperture 35 therein for purposes to be described below. In order to maintain the textile yarn package carrier mechanism 25 stationary during rotation of the rotor mechanism 11, there are provided magnets 36 carried by the bottom portion 28 and cooperating with magnets 37 carried by the balloon limitor 34 to prevent rotation of the carrier mechanism 25.

The spindle assembly 10 further includes a flyer mechanism 38 mounted on the yarn entry tube 32 for free rotation about the axis of the spindle assembly 10. There is further provided a take-up mechanism (not shown) including a yarn take-up or package roll upon which the yarn Y is wound after being processed by the spindle assembly station 10. The take-up mechanism is conventional in a two-for-one twister yarn processing machine and an illustration thereof and further explanation is not believed necessary for a full understanding of this invention.

With the above-described mechanisms of the spindle assembly 10, the yarn Y passes from package P, through the rotating flyer mechanism 38, and into the yarn entry tube 32. The yarn Y then passes downwardly through the collective yarn passageway 33, 52, 24 and 20, emerging from the yarn reserve disc 16 in a generally horizontal direction. The yarn Y then passes upwardly between the basket 27 and the balloon limitor 34 and forms a rotating balloon of yarn which is contained by the balloon limitor 34. The yarn Y then passes upwardly to the take-up mechanism (not shown) to complete its travel through the respective spindle assembly station 10. As is well understood by those with ordinary skill in the art, a two-for-one twist is inserted into the yarn Y during the above-noted path of travel.

To assist in threading the yarn Y from the package P through the respective passageways 33, 52, 24, 20 of the hollow spindle assembly 10, during a periodic thread-up operation when rotation of the rotor mechanism 11 is stopped, the spindle assembly 10 is provided with pneumatically operated yarn threading mechanisms, generally indicated at 40.

Figures 2, 3, 4, 5, 6:
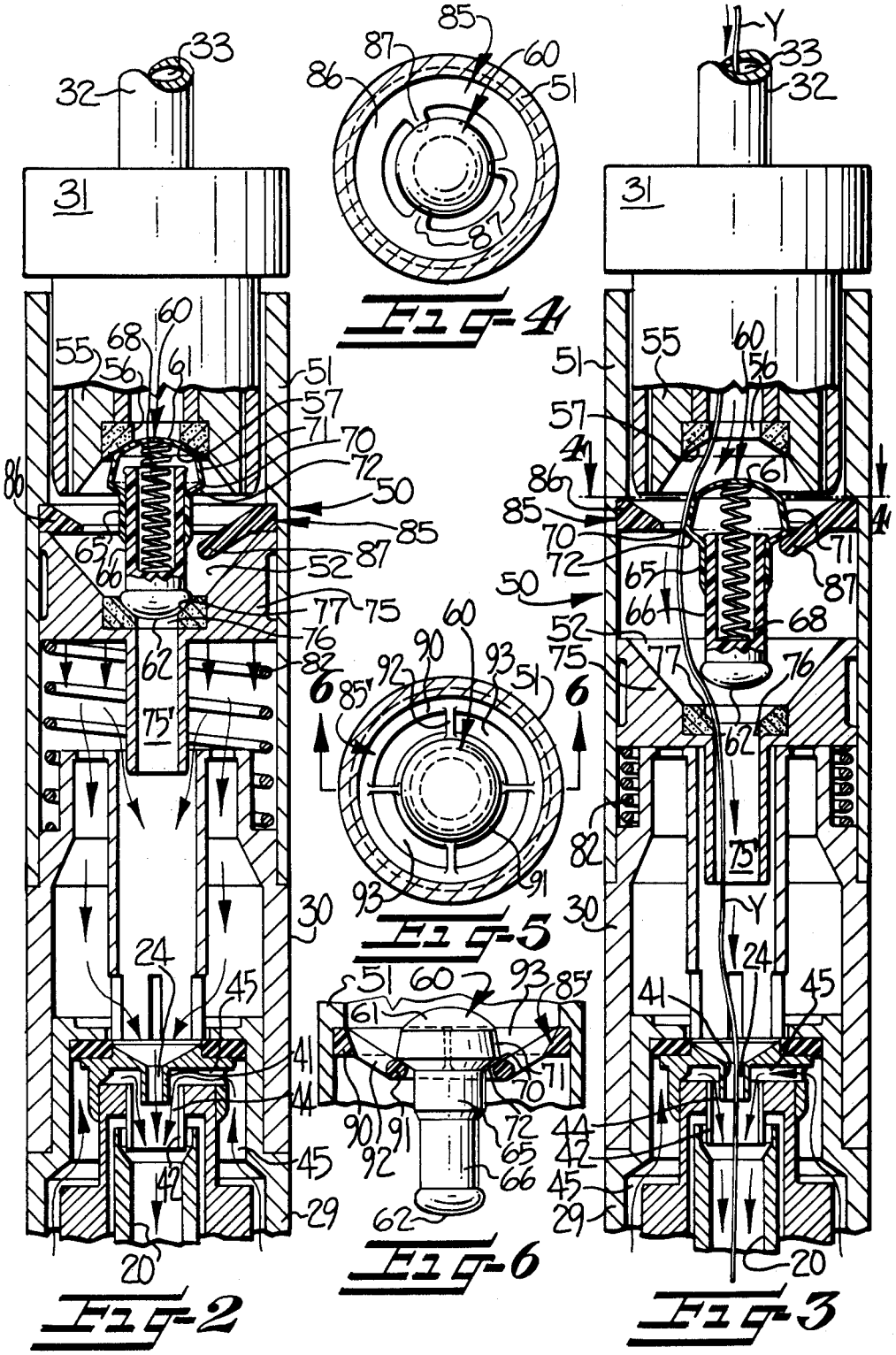
FIG. 2 is a partial, side elevational view of the spindle of the spindle assembly shown in FIG. 1, with portions thereof shown in cross-section to illustrate the yarn brake shown in operative braking engagement, and with the pneumatic threading mechanism having just been activated to create a pneumatic flow, but prior to disengagement of the yarn brake.
FIG. 3 is a view, like FIG. 2, showing the yarn brake in its released position during a threading-up operation.
FIG. 4 is a sectional view, taken generally along the line 4—4 of FIG. 3, illustrating the configuration of the intercepting means for receiving and holding the braking body of the yarn brake during threading-up operations.
FIG. 5 is a view, similar to FIG. 4, of an alternate embodiment of an intercepting means.
FIG. 6 is a sectional view, taken generally along the line 6—6 of FIG. 5.

The yarn threading mechanisms 40, more particularly, as seen for example in FIGS. 2 and 3, comprise an elongate hollow tubular air injector nozzle 41 which is mounted at the upper end of the hub portion 29 and has a passageway 24 forming a part of the collective yarn passageway 33, 52, 24, 20. The air injector nozzle 41 extends downwardly into a hole formed in the upper end portion 42 of the carrier mechanism, and is located in spaced relationship therefrom to form an annular gap 44 therebetween. The annular gap 44 is communicatively connected to an annular compressed air passageway 45 which extends upwardly within the hub portion 29 from the circular bottom portion 28 of the carrier mechanism 25.

When compressed air is supplied to compressed air duct 46 during a thread-up operation, this air passes through the compressed air passageway 45 and then downwardly through the annular gap 44 between the air injector nozzle 41 and the surrounding wall 42. This produces a suction or negative air flow in the passageway 33 of the yarn entry tube and in the yarn passageway 52 through the yarn brake 50 and a positive air flow through the passageway 20 located therebelow. Thus, a yarn Y which is withdrawn from a package P and placed near the yarn entry tube 32 will be sucked through the passageway 33, 52, 24 and then blown out through the passageway 20.

Compressed air may be selectively supplied to the compressed air duct 46 of the carrier mechanism 25 during a thread-up operation by suitable means, as for example, the arrangement shown in commonly-owned U.S. Pat. Nos. 3,945,184 or 3,975,893. Thus, as shown by way of illustration in FIG. 1, compressed air may be selectively supplied by means of a selectively movable connector member 49 which is connected to a compressed air supply (not shown). The connector member 49 is positioned for movement into and out of connecting engagement with the entrance to the duct 46 formed in the carrier member 25 through the aperture 35 in the balloon limitor 34.

In accordance with the present invention, the improved yarn brake 50 is positioned within or forms a part of the tubular housing 30 of the spindle assembly 10 for applying a desired tension to the yarn Y passing therethrough during processing of the yarn.

As illustrated herein, the yarn brake mechanism 50 includes the tubular housing 51 which either forms a part of or an extension of the housing 30 of the spindle assembly 10 and which receives the cap 31 at the upper end thereof. The tubular brake housing 51 includes the aforementioned vertically-extending passageway 52 therethrough which connects with the yarn passageway 33 of the entry tube 32 and leads to the yarn passageway 20 of the carrier mechanism 25 for receiving and allowing passage of the moving yarn Y therethrough.

A stationary member 55 is mounted within the brake housing 51 in an upper portion of the passageway 52 therethrough and includes a vertically-extending aperture 56 therethrough and a downwardly-facing braking surface 57 around the aperture 56 for passage of the yarn Y therethrough. This braking surface 57 may be in the form of an insert in the stationary member 55 and preferably defines a braking surface of a downwardly-facing annular conical configuration surrounding the aperture 56 and providing an entry for the yarn Y into the yarn brake 50 from the passageway 33 of the yarn entry tube 32. If desired, the stationary element 55 may be lockable at various heights for adjustment of the braking force of the yarn brake 50.

A braking body 60 is movably positioned within the passageway 52 of the brake housing 51 and is of predetermined dimensions allowing the passage of the yarn Y through the passageway 52. The braking body 60 includes upper and lower braking surfaces 61, 62 which are preferably formed by generally hemispherical or calotte-shaped outer ends on the braking body 60.

The braking body 60 may comprise a pair of telescoping hollow members 65, 66 forming a generally capsule-shaped brake cartridge with a coil spring biasing means 68 disposed therewithin to bias the members 65, 66 apart to aid in the braking action thereof, to be described below. The braking body 60 further includes a shoulder 70 formed thereon and which may be defined by a first downwardly-widening frusto-conical outer surface portion 71 extending from the upper hemispherically-shaped outer end 61 and a second downwardly-narrowing frusto-conical surface portion 72 extending from the first portion 71.

The yarn brake 50 further includes a movable member 75 positioned for longitudinal axial movement in a lower portion of the passageway 52 of the brake housing 51 below the braking body 60 and having a vertically-extending aperture 76 therethrough and an upwardly-facing braking surface 77 around the aperture 76 for passage of the yarn Y therethrough and forming an exit for the yarn Y out of the yarn brake 50. The braking surface 77 may be formed by an insert mounted in the movable member 74 and preferably defines a braking surface of an upwardly-facing annular conical configuration for cooperating and being engageable with the lower braking surface 62 of the braking body 60. The movable member 75 may include a hollow extension 75' extending downwardly therefrom and having an axially aligned yarn passageway therethrough which mates with an axially aligned passageway through the tubular housing 30 and into the passageway 24 through injector nozzle 41 to allow passage of the yarn Y from the aperture 51 in the movable member 75 into the injector nozzle 41 of the pneumatic threading mechanisms 40.

The yarn brake 50 further includes means, preferably in the form of a coil spring 82, which is operatively associated with the movable member 75 by extending between an upper portion of the tubular housing 30 and the bottom of the movable member 75 for biasing the movable member 75 upwardly toward the stationary member 55 and into a position in which the braking surfaces 61, 62 of the braking body 60 are in braking engagement with the braking surfaces 57, 77 of the stationary and movable members 55, 75 to apply tension to the yarn Y.

As indicated by the arrows in FIG. 2 schematically illustrating the pneumatic flow created by the pneumatic threading mechanisms 40, a suction will be created above the air injector nozzle 41 against the underside of the movable member 71 to create a displacing force tending to move the movable member 75 downwardly against the bias of the spring 82. This displacing force created by the pneumatic flow is greater than the biasing force of the spring 82. Thus, when the pneumatic threading mechanisms 40 are actuated for a threading-up operation, the movable member 75 will be moved downwardly to the position shown in FIG. 3 allowing separation of the braking body 60 from the stationary and movable members 55, 75 and the braking surfaces thereof so as to open up the passageway 52 through the yarn brake 50 for easy threading of the yarn Y therethrough, as shown in FIG. 3.

To overcome the problems presented by prior yarn brakes of this general type, the present invention provides intercepting means 85 mounted in a stationary position in the passageway 52 of the brake housing 51 and which preferably includes an outer generally ring-shaped annular member 86 mounted in the brake housing 51 and in the passageway 52 and having a plurality of inwardly-directed support projections 87 for receiving the shoulder portion 70 of the braking body 60 when the braking body 60 moves under the influence of gravity due to downward movement of the movable member 75 for receiving and holding the braking body 60 in a position in which the braking surfaces 61, 62 thereof remain substantially axially aligned with the braking surfaces 55, 75 of the stationary member 55 and movable member 75 for easily returning to braking engagement after yarn threading. The projections 87 of the intercepting means 85 are preferably directed obliquely downwardly in the passageway 52 for ease in receiving the shoulder portion 70 of the braking body 60 and for opening up the yarn passageway therearound for ease in the threading-up operation.

Another embodiment of an intercepting device 85' is illustrated in FIGS. 5 and 6 and is formed of a hollow ringlike member 90 adapted for mounting in the passageway 52 of the brake housing 51 and having a substantially annular support 91 to be positioned generally centrally of the passageway 52 for receiving the shoulder portion 70 of the braking body 60. This annular support 91 is connected to the member 90 by connections 92 which define openings 93 therebetween for the passage of the yarn Y.

Accordingly, a yarn brake 60 has been provided by this invention wherein the braking body 50 will be held in a central axial position following separation from its cooperating braking surfaces during threading-up of yarn Y so as to be easily returnable to braking engagement after the threading-up operation and eliminating problems presented with prior yarn brakes of this general type.

In the drawings and specification there have been set forth preferred embodiments of the invention, and although specific terms are employed, they are used in a generic and descriptive sense only and not for purposes of limitation.

What is claimed is:

1. A yarn brake for applying tension to a moving yarn comprising:

a brake housing having a vertically-extending passageway therethrough for receiving a yarn moving in a predetermined direction;

a braking body movably positioned within said passageway of said brake housing and being of predetermined dimensions allowing the passage of the yarn through said passageway and having upper and lower braking surfaces thereon;

a stationary member positioned in an upper portion of said passageway of said brake housing above said braking body and having a vertically-extending aperture therethrough and a downwardly-facing braking surface around said aperture for passage of the yarn therethrough and for cooperating and being engageable with said upper braking surface of said braking body;

a movable member positioned for longitudinal axial movement in a lower portion of said passageway of said brake housing below said braking body and having a vertically-extending aperture therethrough and an upwardly-facing braking surface around said aperture for passage of the yarn therethrough and for cooperating and being engageable with said lower braking surface of said braking body;

means operatively associated with said movable member for biasing said movable member upwardly toward said stationary member and into a position in which said braking surfaces of said braking body are in braking engagement with said braking surfaces of said stationary and movable members to apply tension to the yarn and for allowing downward movement of said movable member under the influence of a displacing force greater than the biasing force for separation of said braking body from said stationary and movable members for threading of yarn through said yarn brake; and intercepting means mounted in said passageway of said brake housing and being constructed and positioned for receiving and holding said braking body, upon downward movement of said movable member during yarn threading, in a position in which said braking surfaces of said braking body and said stationary and movable members are out of engagement, but remain substantially aligned, for proper return to braking engagement after the yarn threading and upon upward movement of said movable member.

2. A yarn brake, as set forth in claim 1, in which said braking surfaces of said stationary member and said movable member have a substantially annular conical configuration surrounding said apertures in said members, and said braking body comprises an elongate member having generally hemispherically-shaped outer ends forming said upper and lower braking surfaces and a radially outwardly projecting shoulder portion therearound intermediate the ends thereof for being received by said intercepting means.

3. A yarn brake, as set forth in claim 2, in which said projecting shoulder on said braking body comprises a first downwardly-widening frusto-conical outer surface portion extending from said upper hemispherically-shaped outer end and a second downwardly-narrowing frusto-conical surface portion extending from said first surface portion.

4. A yarn brake, as set forth in claim 2 or 3, in which said braking body comprises a pair of telescoping hollow members forming a generally capsule-shaped brake cartridge and a spring biasing means disposed within said cartridge for biasing said members apart to aid in the braking action when said braking body is in engagement with said stationary and movable members.

5. A yarn brake, as set forth in claim 2 or 3, in which said intercepting means comprises an annular member mounted on said braking housing in said passageway and having a plurality of inwardly-directed support projections for receiving said shoulder portion of said braking body.

6. A yarn brake, as set forth in claim 5, in which said inwardly-directed support projections of said intercepting means are directed obliquely downwardly in said passageway for ease in receiving said shoulder portion of said braking body.

7. A yarn brake, as set forth in claim 2 or 3, in which said intercepting means comprises a ring-like member mounted in said brake housing within said passageway and having a substantially annular support generally centrally of said passageway for receiving said shoulder portion of said braking body and openings around said support portion to allow passage of the yarn.

8. In a spindle assembly of a textile yarn processing machine, especially a two-for-one twister, having a hollow spindle defining an axial yarn passageway extending therethrough and including pneumatic threading mechanisms for selectively creating a pneumatic flow in a predetermined direction through said yarn passageway to automatically thread a yarn therethrough during a thread-up operation; the combination therewith of an improved yarn brake for applying tension to a moving yarn passing through said yarn passageway during normal operation and to facilitate pneumatic threading of the yarn through sad passageway during a threading-up operation, said yarn brake comprising a braking body movably positioned within said passageway of said spindle and being of predetermined dimensions allowing the passage of the yarn through said passageway and having upper and lower braking surfaces thereon;

a stationary member positioned in said passageway of said spindle above said braking body and having a vertically-extending aperture therethrough and a downwardly-facing braking surface around said aperture for passage of the yarn therethrough and for cooperating and being engageable with said upper braking surface of said braking body;

a movable member positioned for longitudinal axial movement in said passageway of said spindle below said braking body and having a vertically-extending aperture therethrough and an upwardly-facing braking surface around said aperture for passage of the yarn therethrough and for cooperating and being engageable with said lower braking surface of said braking body;

spring means operatively associated with said movable member for biasing said movable member upwardly toward said stationary member and into a position in which said braking surfaces of said braking body are in braking engagement with said braking surfaces of said stationary and movable members to apply tension to the yarn, said spring biasing means applying a force in opposition to and less than the force of the pneumatic flow created by said pneumatic threading mechanisms for allowing downward movement of said movable member under the influence of the pneumatic flow selectively created by said pneumatic threading mechanisms for separation of said braking body from said stationary and movable members for threading of yarn through said yarn brake; and intercepting means mounted in said passageway of said spindle and being constructed and positioned for receiving and holding said braking body, upon downward movement of said movable member during yarn threading, in a position in which said braking surfaces of said braking body and said stationary and movable members are out of engagement, but remain substantially aligned, for easily returning to braking engagement after the yarn threading and upon upward movement of said movable member.

9. In a spindle assembly, as set forth in claim 8, in which said braking surface of said stationary member and said movable member have a substantially annular conical configuration surrounding said apertures in said members, and said braking body comprises an elongate member having generally hemispherically-shaped outer ends forming said upper and lower braking surfaces and a radially outwardly projecting shoulder portion therearound intermediate the ends thereof for being received by said intercepting means.

10. In a spindle assembly, as set forth in claim 8 or 9, in which said intercepting means comprises an annular member mounted on said brake housing in said passageway and having a plurality of inwardly-directed, obliquely downwardly-extending, support projections for receiving said shoulder portion of said braking body.

* * * * *